US005780133A

United States Patent [19]

Engstrom

[11] Patent Number: 5,780,133

[45] Date of Patent: Jul. 14, 1998

[54] VARIABLE VALUE RETAIL COUPON SYSTEM

[76] Inventor: John A. Engstrom, 250 N. Golden Circle Dr., Santa Ana, Calif. 92705

[21] Appl. No.: 729,500

[22] Filed: Oct. 11, 1996

[51] Int. Cl.[6] ..... B65D 65/28

[52] U.S. Cl. ..... 428/40.1; 229/70; 283/51; 283/52; 283/56; 283/98; 283/105; 283/106; 283/901; 428/43; 428/192

[58] Field of Search ..... 428/40.1, 43, 192; 283/56, 901, 98, 105, 106, 51, 52; 229/70

[56] References Cited

U.S. PATENT DOCUMENTS

| | | | |
|---|---|---|---|
| 3,734,544 | 5/1973 | Fishkin | 283/56 |
| 4,817,990 | 4/1989 | Krost | 283/56 |
| 5,052,718 | 10/1991 | Gold | 283/56 |
| 5,100,180 | 3/1992 | Tucker | 283/56 |
| 5,102,168 | 4/1992 | Gold | 283/56 |
| 5,139,286 | 8/1992 | Gold | 283/56 |
| 5,141,254 | 8/1992 | Ring | 283/56 |

*Primary Examiner*—Nasser Ahmad
*Attorney, Agent, or Firm*—Allen A. Dicke, Jr.

[57] ABSTRACT

The variable value retail coupon system comprises a sheet which is covered to hide coupons and two offers with each coupon. First and second longitudinal perforation lines, preferably parallel and along the side edges, extend to separate the offers from the coupons. One of the edge tear tabs defined by the perforation lines is chosen and torn away before opening and making the coupons visible so that a selection is made from between the two coupon offers with the tearing away of a chosen one of two edge tear tabs.

26 Claims, 4 Drawing Sheets

VARIABLE VALUE RETAIL COUPON SYSTEM

FIELD OF THE INVENTION

This invention is directed to an improved variable value retail coupon system which carries at least one coupon of variable offer together with two pull strips. Pulling of either one of the strips destroys one offer and permits the exposure of the other offer.

BACKGROUND OF THE INVENTION

Consumer goods companies are always looking for effective ways to increase the market share of their brands. The variable offer or "self-destruct" retail coupon is one such technique. The consumer is encouraged to purchase more product or convert from a competitor's product. The variable offer or "self-destruct" retail coupon is arranged with one or more variable offer coupons, and one of the offers is to be selected by the consumer. When the selection is made, the selected offer remains intact with its coupon and can be redeemed at the store, while the non-selected offer portion of the coupon is destroyed and rendered invalid, thereby negating double redemption. A coupon is rendered invalid when it lacks the essential terms such as the legal terms and conditions covering the consumer redemption conditions and retailer reimbursement text.

Various designs for option or self-destruct coupons have been suggested or put into actual use. Generally, they have not been adequately satisfactory in accomplishing their intended purpose. The manner in which the option or self-destruct coupon is to be used might not be clearly understood by the consumers. The arrangement of the coupons can confuse the consumer. The invalidation of the non-selected coupon might be inadequate, so that the "destroyed" coupon retains the appearance of a valid coupon. The design may foster or cause the inadvertent and unintentional destruction of the wrong coupon.

SUMMARY OF THE INVENTION

In order to aid in the understanding of this invention, it can be stated in essentially summary form that it is directed to an improved variable value retail coupon system where at least one coupon with at least two different offers is formed on the sheet and provisions are made to hide the coupon. A separation line is spaced from each end to define two separate removal tabs. Instructions advise the user to detach or remove only one of the tabs and then to open the remaining portion of the sheet. The removal destroys one of the two offers. On opening, the selected coupon offer is exposed for use.

It is a purpose and advantage of this invention to provide a variable value coupon system wherein the removal of one offer of the coupon assembly destroys one offer so that, when the coupon assembly is thereafter opened, other offers remain intact.

It is another purpose and advantage of this invention to provide a variable value coupon system which permits a retail business such as a grocery supermarket to give a higher value offer to its competitor's customers.

It is a further purpose and advantage of this invention to provide a variable value coupon system wherein the variation and value is based on a choice made by the consumer.

It is another purpose and advantage of this invention to provide a variable value coupon system wherein a plurality of coupons are hidden, and each has a plurality of offers associated therewith, together with directions which request the consumer to remove one tab, with the removal of that tab controlling the value of the coupon offer.

It is another purpose and advantage of this invention to provide a variable value retail coupon system wherein a sheet has multiple coupons, each with multiple offers thereon and is folded so that the multiple coupons overlap each other. The sheet is perforated so that one portion or another portion of the sheet may be removed to invalidate one offer, but leave the selected offer complete.

It is a further purpose and advantage of this invention to provide a variable value retail coupon system wherein a plurality of variable value coupon offers can be assembled together and distributed as an assembly.

Other purposes and advantages of this invention will become apparent from a study of the following portion of the specification, the claims and the attached drawings.

DESCRIPTION OF THE PREFERRED EMBODIMENT

Figure 1:
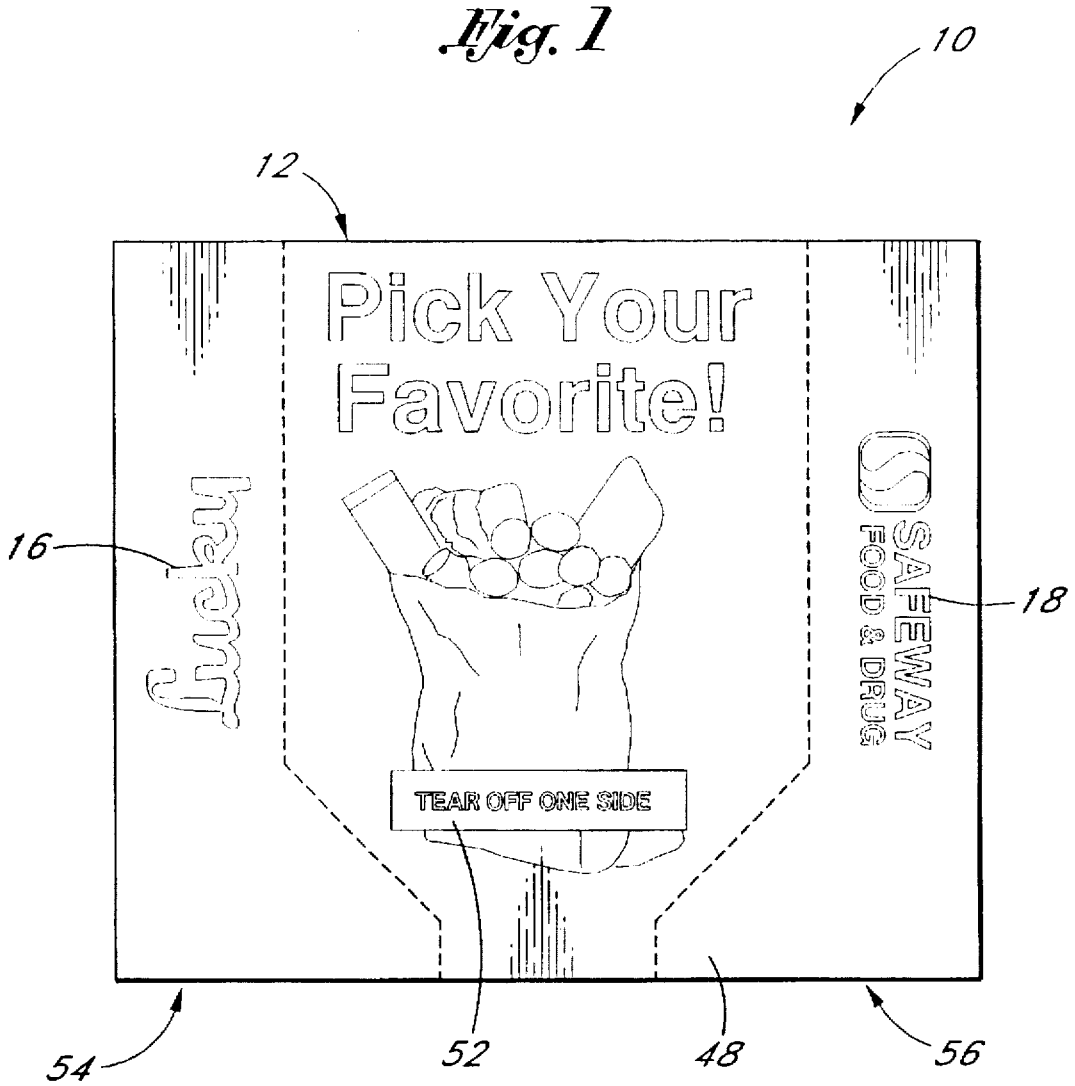
FIG. 1 is a front-elevational view of the improved variable value retail coupon system of this invention as it is distributed to the consumer.

FIG. 1 shows the exterior of the improved variable value retail coupon system 10. In FIG. 1, it is in the form as delivered to the consumer. The coupon system 10 is formed on the front 14 of a sheet of paper 12, which is folded over at least once, as described below. In the distributed form, it is glued along the edge so that it remains in the folded position during delivery. The edge glue holds the retail coupon system 10 together and forces the consumer to pull off one of the side tabs to gain access to the coupons hidden inside the coupon system by the folding. The back face of the coupon system 10, away from the viewer in FIGS. 1 and 2, may have address indicia thereon, if the coupon system 10 is to be delivered individually by the U.S. Postal Service. The front of the folded coupon system, as seen in FIG. 1, may carry the sponsor's name and company name on store indicia 16 and 18 thereon between which the consumer is to be given a choice, or ask a question requiring consumer choice.

Figure 4:
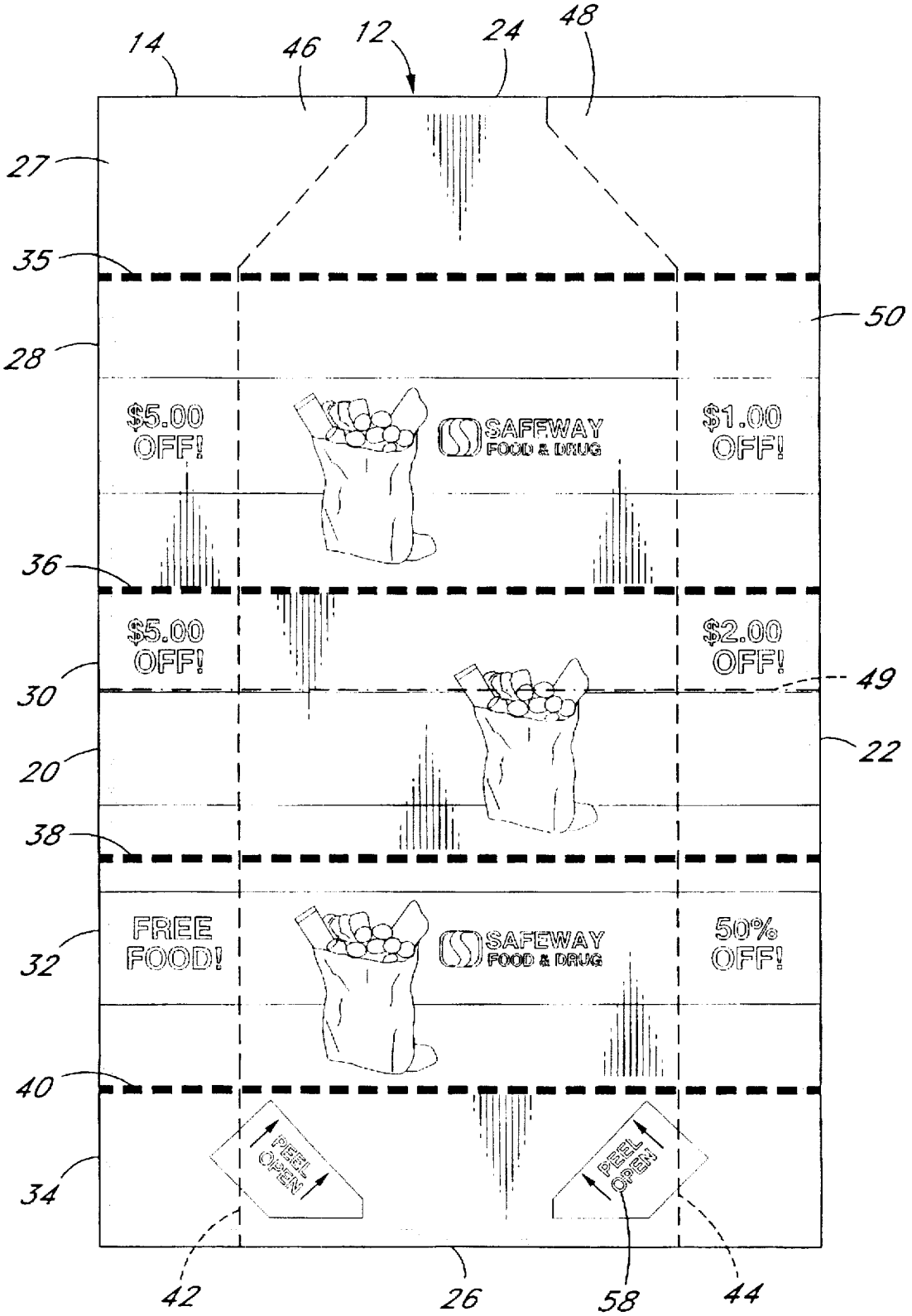
FIG. 4 is a plan view of the inside in the unfolded condition, not seen by the comsumer.

The coupon system may be most readily understood when first observed in the unfolded position shown in FIG. 4. This is the condition of the coupon system 10 when it comes off the printing press before it is folded and glued around the outer edges. The sheet 12 is defined by left and right edges 20 and 22, as well as top and bottom edges 24 and 26. The sheet 12 is divided into a plurality of panels 27, 28, 30, 32 and 34 by four separation lines, which are preferably tear line perforations 35, 36, 38 and 40. In addition, the sheet 12 has two separation lines which are preferably tear line perforations 42 and 44 running parallel to the edges 20 and 22 substantially for the entire length thereof.

At the top panel 27, the perforation lines 42 and 44 angle inwardly at the upper end to define triangular cover tabs 46 and 48. Each of the panels carries printed information on the coupon surface, which is the surface seen in FIGS. 3 and 4.

The information may include a logo and may include directions. Several of the panels can carry coupons thereon. The offer portion of the coupons outside of the tear line perforations 42 and 44 is different on the opposite sides of the coupon. After the printing is completed, the sheet is folded into the system. The upper half of sheet 12 is folded down over the lower half on midpoint fold line 49. The folded half sheets are attached by means of a line 50 of glue, which extends around the periphery. This is light glue that secures the edges, but permits easy and convenient separation so that the parts can be pulled apart without tearing the paper. The glue is sufficiently strong to hold the assembled system 10 together after it is folded to hide the coupons until one of the tabs is pulled. The folding could be done on other lines; for example, the folding could be done with multiple fold lines so the coupon panels overlie themselves as the folding occurs. The folding hides the offers so that the user does not know the value of the offer he is saving or destroying before he opens the system. Other structures, such as a separate cover sheet can be used for the same purpose. Such a cover sheet would have edge perforations corresponding to perforation lines 42 and 44.

Figure 2:
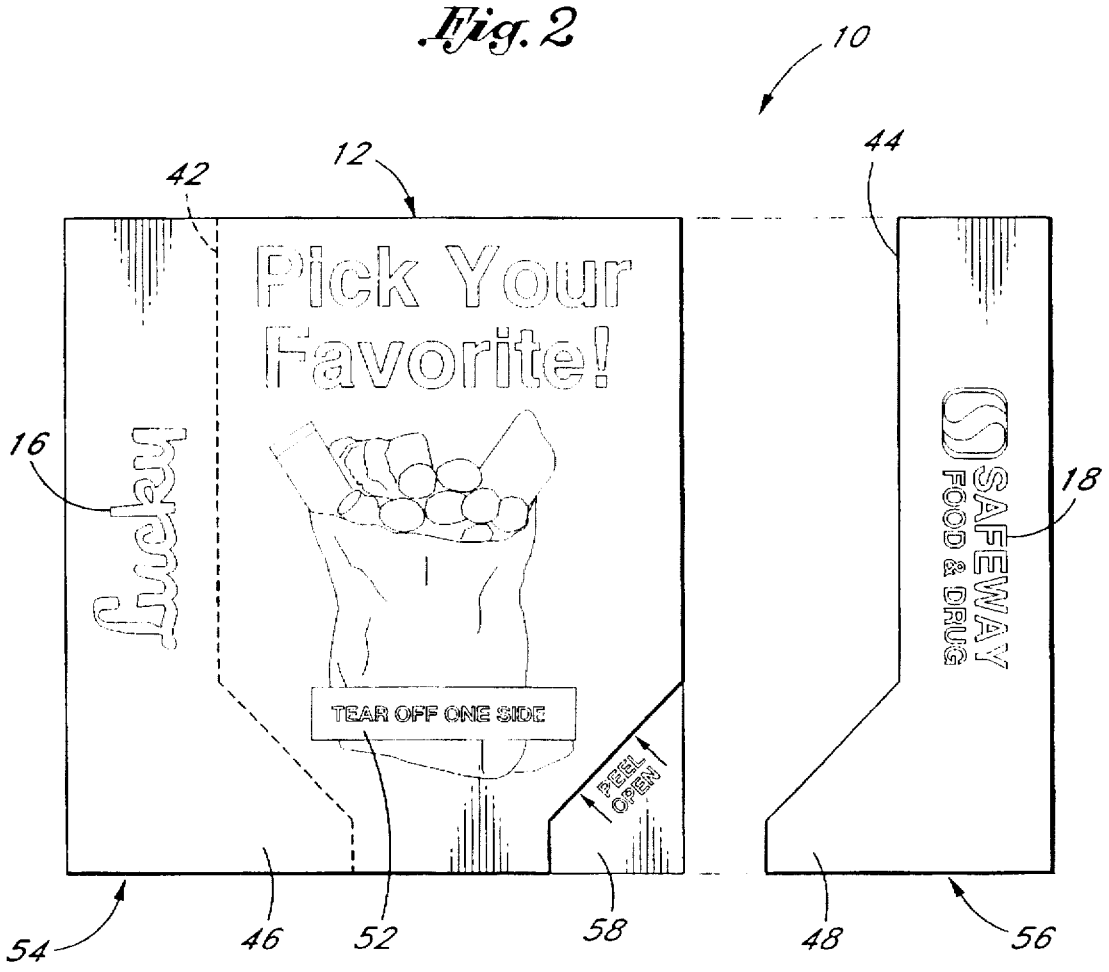
FIG. 2 is a view similar to FIG. 1 with one of the two tabs separated.

The folding on line 49 places the system into the condition shown in FIGS. 1 and 2. The front of the system 10, as seen in FIG. 2 carries indicia 52, which advises the user to pull off one, but not both of the edge tear strips or tabs 54 and 56 which respectively lie outside of the perforation lines 42 and 44. In the illustration of FIG. 1, the choice is between two grocery store chains. The coupon system will make different coupon offers to his customers than to his competitor's customers. Indicia 52 advises the user to pull off the tab which has the name of his favorite store.

Figure 3:
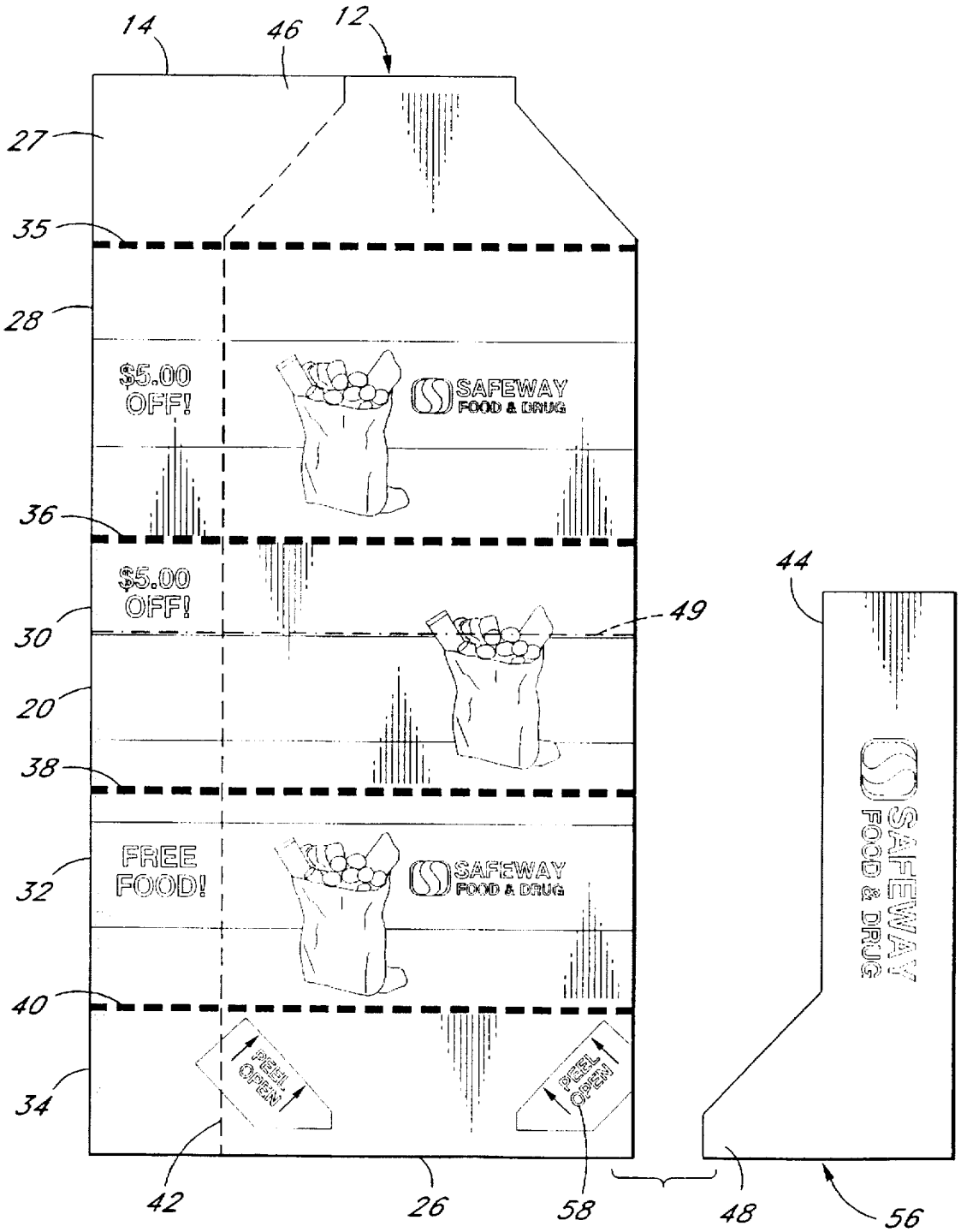
FIG. 3 is a view similar to FIG. 2, showing one of the two tabs removed and seen as it is opened by the consumer.

The condition of the coupon system after the pulling off of the right-hand tab is seen in FIG. 2. The angular cut 48 is convenient to expose the corner 58 of the panel 34, the exterior of which serves as the cover over the coupons and offers as shown in FIG. 1. The angular cut is not necessary, but helps the customer to lift the cover to expose the coupons and remaining offers. The use of the angular cut provides the cover over the corner 58. Removal of the tab then pulls away the angular cut to expose the corner 58. This exposes the instruction to peel open the coupon system. The face side of the panels is seen in FIGS. 3 and 4. The removal of tab 56 removes the right-hand strip of glue along that edge and also exposes the corner 58. This removal of the glue line and exposure of the corner permits easy access by the user to lift the panel 33. Lifting the panel 27 pulls loose the glue line at the edge 24, and successive unfolding of the coupon system pulls apart the glue line on the left side. This exposes the offers on tab 54 which has not been separated from the coupons. This is the condition seen in FIG. 3.

The important thing is that a plurality of the panels 28, 30, and 32 carry thereon indicia which represent variable value coupons. The tearing off of the tab or edge tear strip 56 tears away the information which is not chosen. Choosing the "Safeway" tab to pull off on the right pulls away the tab 56 which has all of the coupon offers to "Lucky" customers. The portions which remain represent "Safeway" coupon offers for "Safeway" customers. Similarly, if the left-hand tab 54 had been torn off choosing "Lucky" as the coupons desired, then the coupon offers to "Safeway" customers would have been torn away with the edge tab 54. Then the coupons would be "Safeway" coupon offers to "Lucky" customers. With one tab removal, all of the coupons are affected and all go one way or the other. Several coupons are connected together and are all of variable value.

This invention has been described in its presently preferred best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A variable value coupon system comprising:

a coupon sheet of flexible material having a face and a back and having edges, at least one coupon panel on said face of said coupon sheet, indicia on said face of said at least one coupon panel, said indicia representing at least one coupon;

first and second spaced separation lines on said coupon sheet for separating said coupon sheet at said separation lines, both said first and second separation lines passing through said coupon indicia, said coupon indicia being arranged to have an offer beyond each separation line so that when torn at said first separation line said coupon has a first character and when torn at said second separation line said coupon has a second character;

a cover extending across said coupon indicia, said cover having first and second spaced separation lines, said cover lying with said first cover separation line overlying said first coupon sheet separation line and said second cover separation line overlying said second coupon sheet separation line so as to enclose said indicia representing said at least one coupon so that said indicia is not visible until said cover and said coupon sheet are separated on one of said first and second separation lines to permit removal of said coupon sheet and cover sheet beyond said separation line to permit uncovering of the remaining face of said coupon sheet to display said indicia.

2. The variable value coupon system of claim 1 wherein there is indicia representing at least two coupons on said face of said sheet and said first and second separation lines cross said indicia representing both said first and second coupons so that both said first and second coupons are variable coupons.

3. The variable value coupon system of claim 2 wherein said separation lines are perforation lines.

4. The variable value coupon system of claim 1 wherein said separation lines are perforation lines.

5. The variable value coupon system of claim 1 wherein said cover is formed by folding over said sheet and there is glue adjacent said edges of said sheet to releasibly retain said cover over said face.

6. The variable value coupon system of claim 3 wherein said first and second perforated separation lines are substantially parallel to each other.

7. The variable value coupon system of claim 6 wherein said first and second perforated separation lines are spaced from the edges of said sheet and define first and second edge tear tabs, said indicia-representing coupons having a portion thereof on each of said tabs.

8. The variable value coupon system of claim 2 wherein there is a line between said panels and said line is a perforated line so that said panels can be separated so that when separated each of said panels represents a separate coupon.

9. The variable value coupon system of claim 7 wherein the ends of said edge tear tabs are exposed, when said sheet is covered to cover said indicia-representing coupon, and said exposed end is cut so that when one of said edge tear tabs is removed it uncovers a portion of a covered panel to aid the user in unfolding said sheet after one of said edge tear tabs is removed.

10. The variable value coupon system of claim 7 wherein there are at least three panels, each having indicia thereon representing variable value coupons.

11. The variable value coupon system of claim 10 wherein the ends of said edge tear tabs are exposed when said sheet is covered to cover said indicia-representing coupons and said exposed end is cut so that when one of said edge tear tabs is removed it uncovers a portion of a covered panel to aid the user in unfolding said sheet after one of said edge tear tabs is removed.

12. The variable value coupon system of claim 10 wherein said sheet is folded to form said cover and said sheet has adhesive adjacent the edges thereof, said adhesive being such as to releasibly hold said sheet in folded position, said adhesive at said edges of said sheet being positioned on said edge tear tabs so that adhesive is removed along one edge of said coupon system when the edge tear tab along that edge is removed.

13. The variable value coupon system of claim 1 wherein said sheet is folded to form said cover and wherein said first and second perforated separation lines are spaced from the edges of said sheet and define first and second edge tear tabs, said indicia-representing coupons having a portion thereof on each of said tabs and said sheet has adhesive adjacent the edges thereof, said adhesive being such as to releasably hold said sheet in folded position, said adhesive at said edges of said sheet being positioned on said edge tear tab so that adhesive is removed along one edge of said coupon system when the edge tear tab along that edge is removed.

14. A variable value coupon system comprising:

a coupon sheet of flexible material, said coupon sheet having a face and having left and right edges, indicia representing at least one coupon on said face of said coupon sheet, said indicia extending substantially from edge to edge of said coupon sheet;

first and second separation lines in said coupon sheet, each of said first and second separation lines extending through some of said indicia so that separation of said coupon sheet on one or the other of said first and second separation lines causes said indicia to represent different values;

a cover sheet over said face of said coupon sheet to cover said indicia, first and second separation lines in said cover sheet, said first separation line in said cover sheet substantially overlying said first separation line in said coupon sheet and said second separation line in said cover sheet substantially overlying said second separation line in said coupon sheet, said first separation lines defining a first tab between said first separation lines and their adjacent sheet edge and defining a second tab between said second separation lines and their adjacent sheet edge so that one of said edge tabs can be removed to select a portion of said indicia and said coupon sheet can be opened to expose the indicia-representing coupon offer.

15. The variable value coupon system of claim 14 wherein there is indicia on said face representing a plurality of coupons, each of said coupons having first and second offers, said first and second offers being positioned respectively adjacent said left and right edges of said sheet of flexible material, said separation lines in both said coupon sheet and said cover sheet being positioned so that when said sheets are separated on said first separation line, said first offer is removed from said coupon and when said sheet is separated on said second separation line, said second offer is removed from said coupon.

16. The variable value coupon system of claim 14 wherein said separation lines comprise perforation lines so that the customer can remove said first tab or said second tab by separating on one of said perforation lines.

17. The variable value coupon system of claim 14 wherein said cover sheet over said face of said coupon sheet comprises a portion of said flexible sheet folded over said face of said coupon sheet, with said cover attached around the edges of said coupon sheet.

18. The variable value coupon system of claim 15 wherein said separating lines are tear line perforations which are substantially parallel to said edges of said sheet to define edge tear tabs which are of substantially uniform width and cover offers on said coupon indicia.

19. The variable value coupon system of claim 18 wherein said tear line perforations have one end thereof extending on an intersecting path so that when one of said edge tear tabs is removed, a portion of a folded-in panel is exposed.

20. The variable value coupon system of claim 18 wherein there is adhesive adjacent said edges to retain said sheet in folded position, said adhesive being positioned so that it is removed when an edge tear tab is removed.

21. The variable value coupon system of claim 20 wherein said tear line perforations have one end thereof extending on an intersecting path so that when one of said edge tear tabs is removed, a portion of a folded-in panel is exposed.

22. The variable value coupon system of claim 14 wherein there are three fold-and-tear perforation lines extending edge to edge defining four panels and at least three of said panels have indicia thereon defining variable value coupons.

23. The variable value coupon system of claim 22 wherein said first and second separation lines are tear line perforations which are substantially parallel to said edges of said sheet so that said edge tear tabs are of substantially uniform width.

24. The variable value coupon system of claim 23 wherein said tear tab perforations have one end thereof extending on an intersecting path so that when one of said edge tear tabs is removed, a portion of a folded-in panel is exposed. expose the indicia-representing coupons.

25. A variable value coupon system comprising:

a coupon sheet of flexible material, said sheet having left and right edges, at least two lateral tear line perforations across said sheet extending between said edges, said perforations dividing said coupon sheet into at least two panels, indicia-representing coupons each having an offer adjacent said edges of said coupon sheet on at least two of said panels, said indicia extending substantially from edge to edge;

cover means for covering said sheet to obscure said indicia;

first and second longitudinal tear line perforations in said coupon sheet and in said cover means, said first and second longitudinal tear line perforations extending at least across said panels having indicia thereon and said longitudinal tear line perforations being positioned to separate said different offers so that separation of said sheet on one or the other of said first and second longitudinal tear line perforations causes said indicia to represent different offers;

said first longitudinal tear line perforations in said cover means substantially overlying said first longitudinal tear line perforations in said coupon sheet to define a first tear tab between said first tear line perforation and its adjacent sheet edge and said second longitudinal tear line perforation in said cover means substantially overlying said second longitudinal tear line perforations in said coupon sheet to define a second tear tab between said second tear line perforation and its adjacent sheet edge so that one of said edge tear tabs can be removed to select a portion of said indicia and the remaining portion of said cover means can be removed to expose the indicia-representing coupons.

26. The variable value coupon system of claim 25 wherein said longitudinal tear line perforations have one end thereof extending on an intersecting path so that when one of said edge tear tabs is removed, a portion of a folded-in panel is exposed.

* * * * *